United States Patent [19]

Marquis

[11] 4,255,627

[45] Mar. 10, 1981

[54] ELECTRICAL SWITCH CONSTRUCTION HAVING AN ADJUSTABLE PIVOTING ACTUATOR THEREFOR AND METHOD OF MAKING THE SAME

[75] Inventor: Edgar E. Marquis, Newtown, Conn.

[73] Assignee: Robertshaw Controls Company, Richmond, Va.

[21] Appl. No.: 3,817

[22] Filed: Jan. 16, 1979

[51] Int. Cl.[3] ..... H01H 43/04

[52] U.S. Cl. ..... 200/38 R; 29/622; 200/38 A; 200/38 FA; 200/38 D

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 39 R, 39 A, 153 T, 332; 29/622

[56] References Cited

U.S. PATENT DOCUMENTS

| | | | |
|---|---|---|---|
| 2,578,824 | 12/1951 | Morrison | 200/38 D |
| 3,965,312 | 6/1976 | Mahon | 200/39 R |
| 4,100,381 | 7/1978 | Marquis | 200/38 A |

*Primary Examiner*—Gene Z. Rubinson
*Assistant Examiner*—Morris Ginsburg
*Attorney, Agent, or Firm*—Candor, Candor & Tassone

[57] ABSTRACT

An electrical switch construction having a stationary frame carrying an electrical switch provided with different operating conditions and an actuator pivotally mounted directly in the frame and operatively associated with the switch for operating the switch to the different conditions thereof in accordance with the pivot position of the actuator about its pivot point in the frame. A timer member is operatively associated with the actuator for repetitively pivoting the actuator about its pivot point to cause the switch to be repetitively in one condition thereof a certain percentage of a certain increment of time and for being in another condition thereof for the remainder of the certain increment of time. An adjustable member is operatively associated with the actuator for changing the pivot point thereof in the frame and in relation to the switch and thereby selecting the amount of the certain percentage of the certain increment of time within certain limits.

20 Claims, 3 Drawing Figures

ELECTRICAL SWITCH CONSTRUCTION HAVING AN ADJUSTABLE PIVOTING ACTUATOR THEREFOR AND METHOD OF MAKING THE SAME

BACKGROUND OF THE INVENTION

1. Field of the Invention

This invention relates to an improved timer operated electrical switch construction and to a method of making the same.

2. Prior Art Statement it is known to provide an electrical switch construction having an electrical switch provided with different operating conditions and having a pivotally mounted actuator operatively associated with the switch for operating the switch to the different conditions thereof in accordance with the pivot position of the actuator about its pivot point, the construction having a timer member operatively associated with the actuator for repetitively pivoting the actuator about its pivot point to cause the switch to be repetitively in one condition thereof a certain percentage of a certain increment of time and for being in another condition thereof for the remainder of the certain increment of time. The construction has means for selecting the amount of the certain percentage of the certain increment of time within certain limits.

For example, see the following U.S. patent:

(1) U.S. Pat. No. 3,965,312–Mahon

It appears that the timer operated electrical switch construction of Item (1) above has an actuator lever that pivots about a fixed pivot point so as to have one end thereof operate an electrical switch and the other end thereof be operated by a rotatable timer means to repetitively pivot the actuator about its fixed pivot point, the timer means having means for adjusting the percentage of on time that the switch is to be actuated by the actuator.

Other means for repetitively varying the condition of an electrical switch comprises cam means directly operating the electrical switch together with means for selecting the amount of time the switch is to be in a certain condition thereof for each increment of time within certain limits.

For example, see the following U.S. patent:

(2) U.S. Pat. No. 4,100,381–Marquis

It appears that the timer operated electrical switch construction of Item (2) above has a rotatable cam member directly operating against a switch blade of the electrical switch and the amount of time that the cam member causes that switch blade to be in contact with another switch blade is determined by the setting of an adjustable part of the rotatable cam.

Other means for selecting the amount of the certain percentage of the certain increment of time within certain limits comprises means for positioning the actuator in a new position thereof relative to the frame carrying the same.

For example, see the following U.S. Patent:

(3) U.S. Pat. No. 2,578,824–Morrison

It appears that the timer operated switch construction of item (3) above has a rotatable cam member operating against a pivotally mounted actuator that controls a switch means in relation to the pivot point of the actuator, the actuator having its pivot point carried by a lever that is pivotally mounted to a stationary frame.

SUMMARY OF THE INVENTION

It is a feature of this invention to provide an improved timer operated electrical switch construction which can be utilized as a variable power switch for various devices.

For example, such timer operated electrical switch construction of this invention can be utilized as a variable power switch for a microwave oven or for providing a variable "defrost period" for a refrigerator.

In particular, it is known to provide a timer operated electrical switch construction which has timer means for repetitively pivoting a switch actuator to repetitively cause the electrical switch to be in one condition thereof a certain percentage of a certain increment of time and for being in another condition thereof for the remainder of the certain increment of time, the timer construction having means for selecting the amount of the certain percentage of the certain increment of time within certain limits.

The improved timer operated electrical switch construction of this invention is of the above type.

For example, one embodiment of this invention comprises an electrical switch construction having a stationary frame means carrying an electrical switch provided with different operating conditions, the construction having an actuator pivotally mounted directly in the frame means and operatively associated with the switch for operating the switch to the different conditions thereof in accordance with the pivot position of the actuator about its pivot point in the frame means. The construction has a timer member operatively associated with the actuator for repetitively pivoting the actuator about its pivot point to cause the switch to be repetitively in one condition thereof a certain percentage of a certain increment of time and for being in another condition thereof for the remainder of the certain increment of time. The construction has means for selecting the amount of the certain percentage of the certain increment of time within certain limits, such means being operatively associated with the actuator for changing its pivot point in the frame means and in relation to the switch and thereby selecting the amount of the certain percentage of the certain increment of time.

Accordingly, it is an object of this invention to provide an improved electrical switch construction having one or more of the novel features of this invention as set forth above or hereinafter shown or described.

Another object of this invention is to provide a method of making such an electrical switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
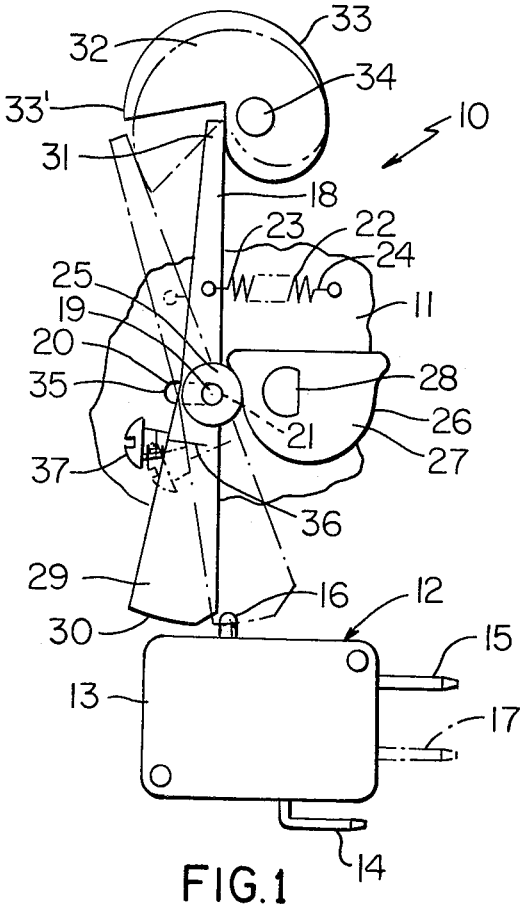
FIG. 1 is a broken-away fragmentary view illustrating the improved timer operated electrical switch construction of this invention.

While the various features of this invention are hereinafter described and illustrated as being particularly adapted to provide a timer operated electrical switch construction for a microwave oven or for a refrigerator, it is to be understood that the various features of this invention can be utilized singly or in any combintion thereof to provide a timer operated electrical switch construction for other devices as desired.

Therefore, this invention is not to be limited to only the embodiment illustrated in the drawings, because the drawings are merely utilized to illustrate one of the wide variety of uses of this invention.

Figure 2:
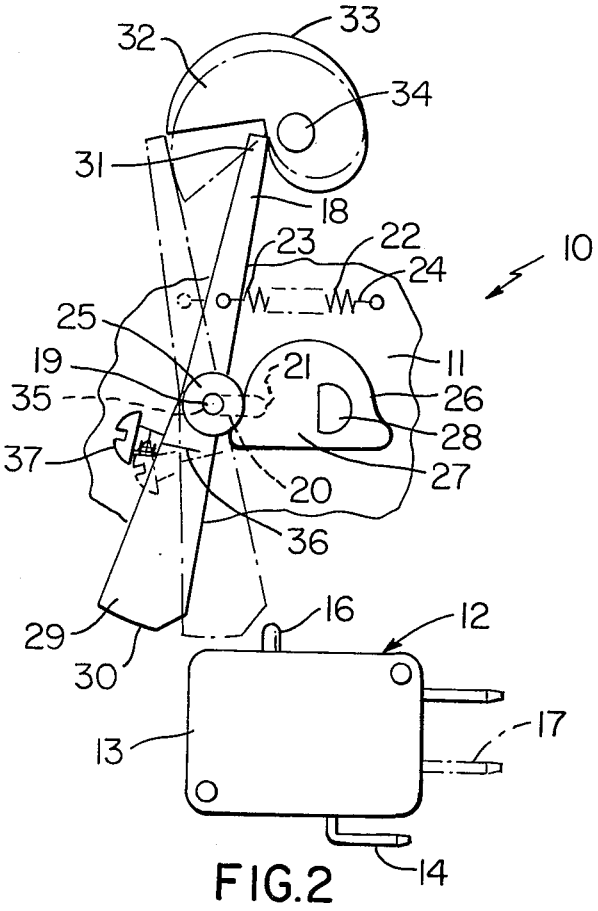
FIG. 2 is a view similar to FIG. 1 and illustrates the electrical switch construction set in another operating condition thereof.

Referring now to FIGS. 1 and 2, the improved timer operated electrical switch construction of this invention is generally indicated by the reference numeral 10 and comprises a frame means 11 carrying an electrical switch that is generally indicated by the reference numeral 12, the switch 12 being conventional and comprising a housing means 13 having suitable switch means therein for normally interconnecting a terminal 14 to a terminal 15 as long as an actuator plunger 16 thereof is in the out condition thereof. However, once the plunger 16 is moved inwardly into the housing means 13 in a manner hereinafter described, the interconnection between the terminals 14 and 15 is interrupted by the switching mechanism in the housing 13 in a manner well known in the art and, if desired, the terminal 14 can be interconnected to another terminal 17 whenever the plunger 16 is in such "in" condition for a purpose that will be apparent hereinafter.

An actuator member 18 is pivotally mounted to the frame 11 by having a pivot pin means 19 thereof disposed in elongated slot means 20 of the frame means 11 and normally being urged toward one end 21 of the slot means 20 by a tension spring 22 having one end 23 interconnected to the actuator 18 and the other end 24 thereof interconnected to the frame means 11 as illustrated. The actuator 18 carries a cylindrical abutment member or roller 25 which engages against a cam surface 26 of a selector cam 27 rotatably mounted to the frame means 11 by a shaft means 28 that eccentrically carried the cam member 27 as illustrated.

The actuator 18 has one end 29 provided with a camming surface 30 for camming and operating against the plunger 16 of the switch 12 to cam the same inwardly when the actuator 18 is pivoted in a counter clockwise direction in FIG. 1 and as represented by the dash-dotted lines therein to cause the plunger 16 to disconnect the terminal 14 from the terminal 15 as long as the actuator 18 has the cam surface 30 thereof operating against the plunger 16 to hold the same in its "in" condition as will be apparent hereinafter.

The other end 31 of the actuator 18 is engageable against a timer driven cam member 32 provided with a peripheral cam surface 33 and being rotatably mounted to the frame means 11 by a shaft means 34 thereof which is driven by suitable timer motor means (not shown) in a manner conventional in the art to continuously rotate the cam member 32 about its axis 34 in a clockwise direction in FIG. 1 for a purpose hereinafter described.

It can be seen that the cam surface 33 of the timer cam 32 is so constructed and arranged that the same will repetitively pivot the actuator 18 about its pivot axis or point 19 from the full line position illustrated in FIG. 1 to the dash-dotted line position of FIG. 1 and then back to the full line position each complete revolution of the timer cam 32 as the force of the tension spring 22 maintains the end 31 of the actutor member 18 in contact with the cam surface 33 during the rotation of the timer cam 32.

The cam surface 26 of the adjusting cam 27 can be positioned by the operator turning the shaft 28 so that the placement of the pivot pin means 19 in the slot means 20 of the frame means 11 is infinitely adjustable anywhere from the extreme righthand condition illustrated in FIG. 1 to the lefthand condition illustrated in FIG. 2 wherein the pin means 19 has been moved all the way to the lefthand end 35 of the slot means 20. When the pin means 19 of the actuator 18 has been set in the condition illustrated in FIG. 2, the repetitive pivoting of the actuator 18 by the timer cam 32 is such that the cam surface 30 on the end 29 thereof cannot operate against the plunger 16 whereby the switch 12 will continuously have the terminal 14 interconnected to the terminal 15 thereof without any cycling of the switch 12 so that the switch 12 will continuously be in an "on" condition thereof.

However, by setting the cam 27 in any position intermediate the positions illustrated in FIGS. 1 and 2, the pin means 19 will be set to an intermediate position within the slot means 20 as determined by the cam surface 26 of the cam 27 pushing against the roller or abutment 25 and the tension spring 22 will maintain the roller or abutment 25 of the actuator 18 against the cam 27 so that the amount of time that the plunger 16 will be held "in" by the actuator 18 for each rotational cycle of the timer cam 32 will be adjusted from the percentage of on time illustrated in FIG. 1 which is substantially 100% toward the percentage of time illustrated in FIG. 2 which is substantially 0%.

If desired, the actuator 18 can be formed of plastic material which forms its own natural hinge so that the same can be partially split, such as by a slit 36 that is located between the end 29 and the pivot pins means 19 thereof, so that a conical threaded adjusting member 37 can be threaded into the split 36 to provide a fine adjustment of the cam end 30 of the actuator 18 relative to the plunger 16 of the switch 12.

Figure 3:
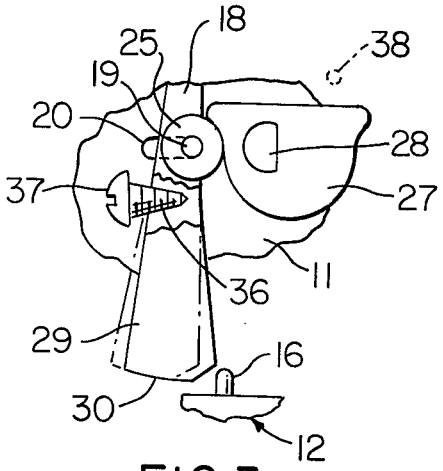
FIG. 3 is a fragmentary view similar to FIG. 1 and illustrates in cross section an adjustment member of the timer operated electrical switch construction of FIG. 1.

In particular, by progressively threading the threaded member 37 into the actuator 18 as illustrated in FIG. 3, the cam end 29 of the actuator member 18 will actually bend closer to the plunger 16 of the switch 12 to provide for a fine adjustment over the rough adjustment provided by the setting of the selector cam 27.

Thus, it can be seen that the timer operated electrical switch construction 10 of this invention can be formed from relatively few parts in a simple manner to operate in a manner now to be described.

The operator of the electrical switch construction 10 decides through suitable dial means (not shown) operatively associated with the shaft 28 of the selector cam 27 the amount of time that the electrical switch construction 10 is to maintain the terminals 14 and 15 interconnected together for each increment of time that the cam timer cam 32 is to complete one complete rotation thereof and sets the rotatable position of the selector cam 27 to such desired percentage of time. If such selected percentage of time is intermediate the full "on" condition time of FIG. 2 and the almost full "off" time of FIG. 1, the rotation of the cam 27 causes the cam surface 26 thereof to operate against the roller or abutment 25 of the actuator 18 to position the pivot pin means 19 thereof in a selected position within the slot means 20 whereby the amount of time that the cam end 29 of the actuator 18 engages against the plunger 16 of the switch means 12 to hold the same in an "in" condition and, thus, disconnect the terminal means 14 and 15 from each other for each complete revolution of the timer cam 32, will be intermediate the 100% time of FIG. 1 and the 0% time of FIG. 2.

For example, as the timer cam 32 rotates from the full line position illustrated in FIG. 1 to the dash-dotted line position illustrated in FIG. 1, it can be seen that the cam surface 33 thereof operates on the end 31 of the actuator 18 to progressively cause the same to pivot in a counterclockwise direction about the pivot pin means 19 so that the cam surface 30 thereof will operate against the plunger 16 to hold the same "in" for a certain increment of time until the high point 33' of the cam surface 33 of the timer cam 32 clears the end 31 of the actuator 18 and permits the tension spring 22 to pivot the actuator 18 back to the full line condition illustrated in FIG. 1 and, thus, disengage the cam surface 30 from the plunger 16 to permit the same to be in its "out" condition and thereby again interconnect the terminals 14 and 15 together for the remainder of that increment of time until the cam surface 33 again causes the pivoting of the actuator 18 in the counterclockwise direction to again operate on the plunger 16.

Therefore, it can be seen that as the actuator 18 is repetitively pivoted back and forth by the timer cam 32, the switch means 12 has the terminal 14 disconnected from the terminal 15 thereof a certain percentage of the complete increment of time that it takes for the cam member 32 to complete one revolution thereof, such certain percentage of time having been selected by the setting of the selector cam 27.

In this manner, should the electrical switch construction 10 be utilized with a microwave oven so that the switch 12 controls the power unit of the microwave oven, the timer cam 32 can have a time base of two revolutions per minute whereby it can be seen that when the selector means selector cam 27 is set in the condition of FIG. 1, the actuator 18 will be depressing the plunger 16 of the switch 12 for most of the time that the cam 32 is rotating so that power for the oven will only be on a short period of time in each revolution of the timer cam 32. However, as the selector cam 27 is rotated clockwise in FIG. 1, the plunger 16 for the switch 12 will be depressed for shorter periods of time for each revolution of the timer cam 32 so that when the selector cam 27 has been rotated approximately 180° in the clockwise direction as illustrated in FIG. 2, the actuator 18 does not depress the switch button or plunger 16 so that the switch contacts of the switch 12 do not open and will provide full uninterrupted power to the power unit of the microwave oven.

Thus, for the microwave oven use of the electrical switch construction 10 of this invention, merely a normally closed switch 12 need be provided so that the terminal 17 and its associated switching means need not be provided.

However, for utilizing the timer operated electrical switch construction 10 of this invention for a variable defroster means for a refrigerator, a normally closed and a normally open type of switch 12 can be utilized so that the normally closed side of the switch would be interconnected to the defrost circuit and the circuit for the compressor for the refrigerator would be interconnected to the normally open side thereof.

With such an arrangement where the terminal 15 in FIG. 1 is interconnected to the defrost circuit and the terminal 17 is interconnected to the circuit for operating the compressor for the refrigerator, the FIG. 1 setting for the switch construction 10 would provide a short defrost period whereas the setting in FIG. 2 would provide for full off of the compressor and for a full defrost mode which would not be appropriate for a refrigerator.

Thus, a stop could be provided to limit the amount of rotation of the selector cam 27 from the position illustrated in FIG. 1 toward the position illustrated in FIG. 2 to prevent full "no" actuation of the switch plunger 16, and such stop being illustrated as item 38 in FIG. 3 so that the pin means 19 of the actuator 18 cannot be moved all the way to the end 35 of the slot means 20 as previously described.

Of course, when the timer construction 10 of this invention is utilized for a refrigerator defrost timer, the time base for rotating the cam timer cam 32 would be approximately one revolution for each 4, 6, 8 hours or longer as desired.

Thus, it can be seen that this invention not only provides an improved timer operated electrical switch construction, but also this invention provides an improved method of making such a timer operated switch construction or the like.

While the form and method of this invention now preferred have been illustrated and described as required by the Patent Statute, it is to be understood that other forms and method steps can be utilized and still fall within the scope of the appended claims.

What is claimed is:

1. In an electrical switch construction having a stationary frame means carrying an electrical switch provided with different operating conditions, said construction having an actuator pivotally mounted directly in said frame means and operatively associated with said switch for operating said switch to said different conditions thereof in accordance with the pivot position of said actuator about its pivot point in said frame means, said construction having a timer member operatively associated with said actuator for repetitively pivoting said actuator about its said pivot point to cause said switch to be repetitively in one condition thereof a certain percentage of a certain increment of time and for being in another condition thereof for the remainder of said certain increment of time, said construction having means for selecting the amount of said certain percentage of said certain increment of time within certain limits, the improvement wherein said means is operatively associated with said actuator for changing its said pivot point in said frame means and in relation to said switch and thereby selecting said amount of said certain percentage.

2. An electrical switch construction as set forth in claim 1 wherein said means is infinitely variable in the selection of said certain percentage.

3. An electrical switch construction as set forth in claim 1 wherein said means is adapted for selecting a continuous operating condition of said switch.

4. An electrical switch construction as set forth in claim 1 wherein said actuator has opposed ends and said pivot point thereof is disposed between said opposed ends thereof, said timer member being operatively associated with one of said opposed ends of said actuator, said switch being operatively associated with the other of said opposed ends of said actuator.

5. An electrical switch construction as set forth in claim 4 wherein said other of said ends of said actuator is adjustable relative to said pivot point of said actuator.

6. An electrical switch construction as set forth in claim 4 wherein said timer member comprises a rotatable cam acting on said one of said opposed ends of said actuator to oscillate said actuator about its said pivot point as said rotatable cam rotates relative thereto.

7. An electrical switch construction as set forth in claim 1 wherein said means comprises a rotatable cam member acting against said actuator.

8. In an electrical switch construction having an electrical switch provided with different operating conditions, said construction having a pivotally mounted actuator operatively associated with said switch for operating said switch to said different conditions thereof in accordance with the pivot position of said actuator about its pivot point, said construction having a timer member operatively associated with said actuator for repetitively pivoting said actuator about its said pivot point to cause switch to be repetitively in one condition thereof a certain percentage of a certain increment of time and for being in another condition thereof for the remainder of said certain increment of time, said construction having means for selecting the amount of said certain percentage of said certain increment of time within certain limits, the improvement wherein said means is operatively associated with said actuator for changing its said pivot point in relation to said switch and thereby selecting said amount of said certain percentage, said means comprising a rotatable cam member acting against said actuator, said construction having a frame means provided with slot means therein, said actuator having pivot pin means disposed in said slot means to define said pivot point thereof, said cam member positioning said pin means in said slot means.

9. An electrical switch construction as set forth in claim 8 and including spring means interconnected to said frame means and said actuator and tending to move said actuator against said cam member and said pivot pin means in one direction in said slot means.

10. An electrical switch construction as set forth in claim 9 and including stop means carried by said frame means for limiting the amount of movement of said pin means in said slot means in a direction opposite to said one direction.

11. In a method of making an electrical switch construction having a stationary frame means carrying an electrical switch provided with different operating conditions, said construction having an actuator pivotally mounted directly in said frame means and operatively associated with said switch for operating said switch to said different conditions thereof in accordance with the pivot position of said actuator about its pivot point in said frame means, said construction having a timer member operatively associated with said actuator for repetitively pivoting said actuator about its said pivot point to cause said switch to be repetitively in one condition thereof a certain percentage of a certain increment of time and for being in another condition thereof for the remainder of said certain increment of time, said construction having means for selecting the amount of said certain percentage of said certain increment of time within certain limits, the improvement comprising the step of forming said means to be operatively associated with said actuator for changing its said pivot point in said frame means and in relation to said switch and thereby selecting said amount of said certain percentage.

12. A method of making an electrical switch construction as set forth in claim 11 and including the step of forming said means to be infinitely variable in the selection of said certain percentage.

13. A method of making an electrical switch construction as set forth in claim 11 and including the step of forming said means to be adapted to select a continuous operating condition of said switch.

14. A method of making an electrical switch construction as set forth in claim 11 and including the step of forming said actuator to have opposed ends and said pivot point thereof disposed between said opposed ends thereof, forming said timer member to be operatively associated with one of said opposed ends of said actuator, and forming said switch to be operatively associated with the other of said opposed ends of said actuator.

15. A method of making an electrical switch construction as set forth in claim 14 and including the step of forming said other of said ends of said actuator to be adjustable relative to said pivot point of said actuator.

16. A method of making an electrical switch construction as set forth in claim 14 and including the step of forming said timer member to comprise a rotatable cam acting on said one of said opposed ends of said actuator to oscillate said actuator about its said pivot point as said rotatable cam rotates relative thereto.

17. A method of making an electrical switch construction as set forth in claim 11 and including the step of forming said means as a rotatable cam member acting against said actuator.

18. In a method of making an electrical switch construction having an electrical switch provided with different operating conditions, said construction having a pivotally mounted actuator operatively associated with said switch for operating said switch to said different conditions thereof in accordance with the pivot position of said actuator about its pivot point, said construction having a time member operatively associated with said actuator for repetitively pivoting said actuator about its said pivot point to cause said switch to be repetitively in one condition thereof a certain percentage of a certain increment of time and for being in another condition thereof for the remainder of said certain increment of time, said construction having means for selecting the amount of said certain percentage of said certain increment of time within certain limits, the improvement comprising the steps of forming said means to be operatively associated with said actuator for changing its said pivot point in relation to said switch and thereby selecting said amount of said certain percentage, forming said means as a rotatable cam member acting against said actuator, forming said construction with a frame means provided with slot means therein, disposing pivot pin means of said actuator in said slot means to define said pivot point thereof, and causing said cam member to position said pin means in said slot means.

19. A method of making an electrical switch construction as set forth in claim 18 and including the step of interconnecting spring means to said frame means and said actuator to tend to move said actuator against said cam member and said pivot pin means in one direction in said slot means.

20. A method of making an electrical switch construction as set forth in claim 19 and including the step of forming stop means to be carried by said frame means for limiting the amount of movement of said pin means in said slot means in a direction opposite to said one direction.

* * * * *